US007095165B2

(12) United States Patent
Baek et al.

(10) Patent No.: US 7,095,165 B2
(45) Date of Patent: Aug. 22, 2006

(54) COLOR CATHODE RAY TUBE

(75) Inventors: Jae-Seung Baek, Daegu (KR); Yong-Hoon Choi, Daegu (KR)

(73) Assignee: LG.Philips Display Korea Co., Ltd., Kyeongsangbuk-Do (KR)

( * ) Notice: Subject to any disclaimer, the term of this patent is extended or adjusted under 35 U.S.C. 154(b) by 149 days.

(21) Appl. No.: 10/678,353

(22) Filed: Oct. 6, 2003

(65) Prior Publication Data

US 2004/0239232 A1 Dec. 2, 2004

(30) Foreign Application Priority Data

May 30, 2003 (KR) ..... 10-2003-0034930
Jun. 30, 2003 (KR) ..... 10-2003-0043997

(51) Int. Cl.
*H01J 29/86* (2006.01)

(52) U.S. Cl. ..... 313/477 R; 220/2.1 A; 220/2.1 R

(58) Field of Classification Search ..... 313/477 R; 220/2.1 R, 2.1 A
See application file for complete search history.

(56) References Cited

U.S. PATENT DOCUMENTS 5,107,999 A * 4/1992 Canevazzi ..... 220/2.1 A
6,072,270 A * 6/2000 Hu et al. ..... 313/402
6,274,977 B1 * 8/2001 Pyun et al. ..... 313/447 R
6,433,470 B1 * 8/2002 Watanabe et al. ..... 313/461
6,639,346 B1 * 10/2003 Bae et al. ..... 313/461
6,806,636 B1 * 10/2004 Kang et al. ..... 313/479

* cited by examiner

*Primary Examiner*—Mariceli Santiago
*Assistant Examiner*—Anthony Perry
(74) *Attorney, Agent, or Firm*—McKenna Long & Aldridge LLP

(57) ABSTRACT

A color CRT comprising a panel having a substantially flat outer surface and an inner surface having a certain curvature, and a mask having a plurality of electron beam passing holes, wherein an effective surface diagonal size of the panel is not greater than about 534 mm, wherein a central portion transmittance rate is within the range of about 45–75%, wherein the panel satisfies the condition $1.1 \leqq (Rxs/Ryc) \leqq 4.6$, wherein Rxs is defined as an inner curvature radius along an edge of a longer side of the panel, and wherein Ryc is defined as an inner curvature radius along a line in the center of the panel parallel to the shorter side of the panel.

33 Claims, 7 Drawing Sheets

COLOR CATHODE RAY TUBE

BACKGROUND OF THE INVENTION

This application claims the benefit of Korean Patent Application Nos. 2003-34390 and 2003-43997 filed on May 30, 2003 and Jun. 30, 2003, which are hereby incorporated by reference for all purposes as if fully set forth herein.

1. Field of the Invention

The present invention relates to a color cathode ray tube, and in particular to a color cathode ray tube capable of satisfying drop requirements and preventing partial doming and howling by adjusting an inner curvature radius and/or a difference of height of a cathode ray tube panel.

2. Description of the Prior Art

In general, a color cathode ray tube (hereinafter CRT) displays images, and it is divided into two types of CRT: a curved-surface CRT and a flat CRT.

Because the curved-surface CRT has problems such as image distortion and light reflection, demand therefore has decreased gradually. On the other hand, because the flat CRT can prevent image distortion and light reflection and implement the maximum visible light region, demand therefore has gradually increased.

FIG. 1 is a side view illustrating a general color CRT. The conventional color CRT includes: a panel 1 having an effective surface on which a phosphor screen *a* is coated; a mask 2 disposed with a predetermined interval to the inner side of the panel 1; a funnel 3 combined with a rear of the panel 1 in order to maintain the inside of the CRT as a vacuum state; and a deflection yoke 5 for deflecting electron beams emitted from the electron gun 4.

In the above-mentioned conventional color CRT, when the electron gun 4 receives an image signal, the electron gun 4 emits an electron beam, and the emitted electron beam is accelerated and focused toward the panel 1 by a voltage applied to each electrode of the electron gun 4. The electron beam is deflected by the deflection yoke 5, color selecting is performed while the electron beams passes a slot (not shown) formed in the mask, and each phosphor screen is irradiated by the electron beam landing on the phosphor screen 1*a* at the internal surface of the panel 1.

In order to satisfy the demand for lower price, lower weight, and slimmer color CRTs, methods for tinting a panel, using a cheap AK mask, increasing/decreasing a center thickness of a panel and flattening the panel have been used. In case of reducing a center thickness of a panel, when a center thickness of a panel is less than the regulation value (it is regulated so as to be greater than 10.5 mm), X-Ray release is increased, and accordingly there is a limitation to the minimum center thickness of the panel. In the panel flattening method, because the internal surface of a panel is gradually flattened, the internal curvature of a mask is gradually decreased, reducing the structural strength of the mask, and accordingly the drop characteristics (drop quality) of the mask decrease.

As described above, when the structural strength and the drop characteristics of the mask deteriorate, because of heat expansion of the mask, an electron beam passing a mask hole can not accurately hit the red, blue, or green phosphor on the screen, the color purity of the screen deteriorates, and accordingly partial doming and howling occur.

As described-above, in a conventional color CRT, particularly in a color CRT smaller than 21", in order to satisfy the structural strength and drop requirements of the mask, the wedge ratio of the panel (thickness ratio of a corner portion to the central portion of the screen) is determined so as to be not less than 220%, the inner curvature radius of the mask is uniformly maintained, and a mask thickness is determined so as to be not less than 0.13 mm. Accordingly, it is impossible to lower a price, obtain slimness and reduce weight of a CRT and meet the above requirements.

SUMMARY OF THE INVENTION

Accordingly, the present invention is directed to color cathode ray tube that substantially obviates one or more of the problems due to limitations and disadvantages of the related art.

An advantage of the present invention is to provide a color CRT structure capable of reducing the price, thickness, and weight of a CRT and improving the structural strength and drop characteristics of a mask by limiting the inner curvature radius or the difference in height of a panel according to each shorter axis, longer axis, and dialog axis.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, A color CRT comprising a panel having a substantially flat outer surface and an inner surface having a certain curvature, and a mask having a plurality of electron beam passing holes, wherein an effective surface diagonal size of the panel is not greater than about 534 mm, wherein a central portion transmittance rate is within the range of about 45–75%, wherein the panel satisfies the condition $1.1 \leqq (Rxs/Ryc) \leqq 4.6$, wherein Rxs is defined as an inner curvature radius along an edge of a longer side of the panel, and wherein Ryc is defined as an inner curvature radius along a line in the center of the panel parallel to the shorter side of the panel.

It is to be understood that both the foregoing general description and the following detailed description are exemplary and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1:
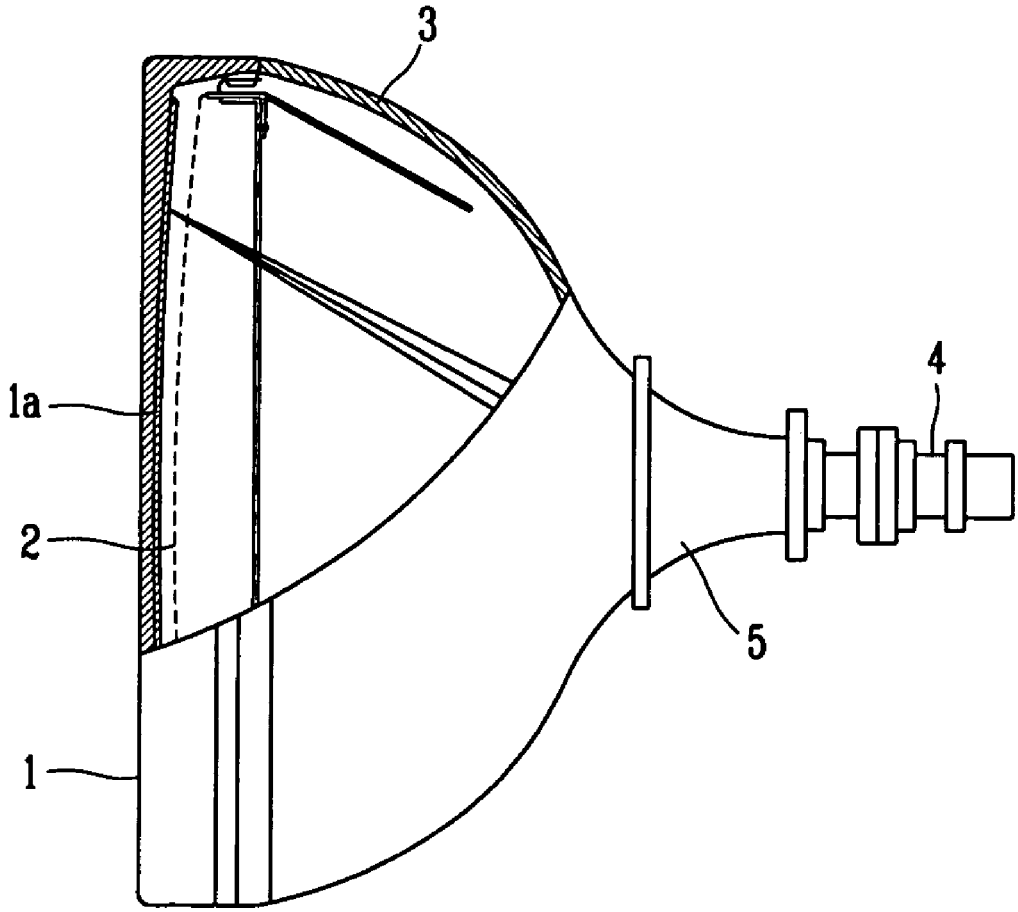
FIG. 1 RELATED ART
FIG. 1 is a side view illustrating a general color CRT.
Figure 2:
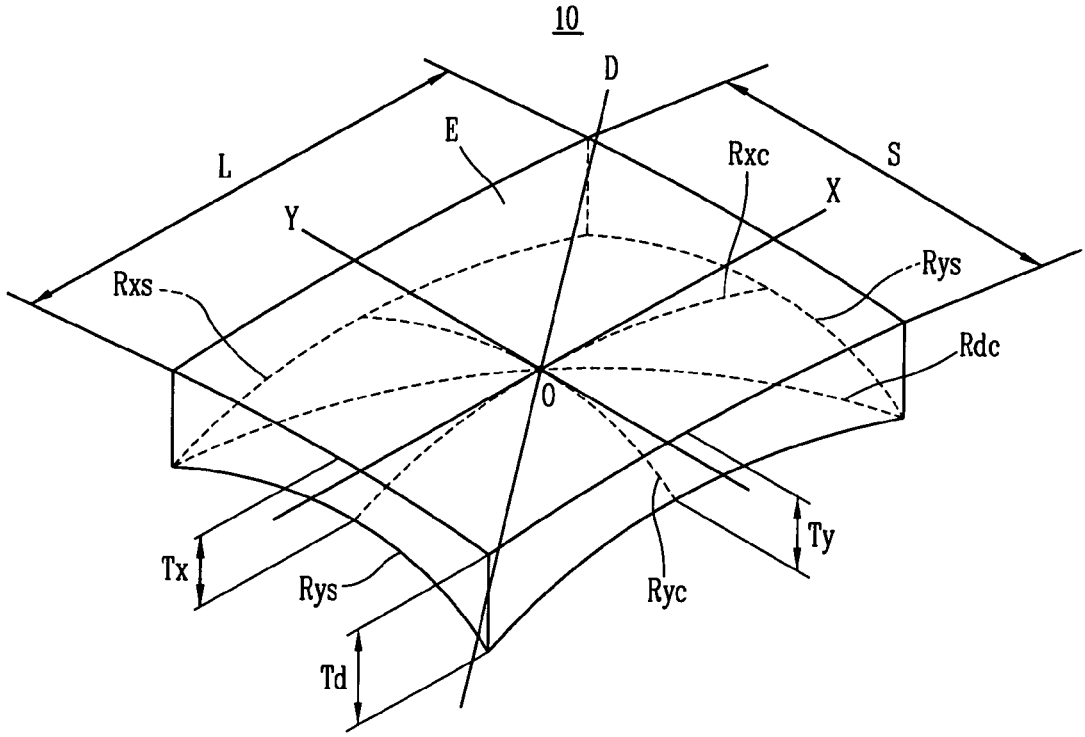
FIG. 2 is a perspective view illustrating an effective surface size of the present invention.
Figure 3:
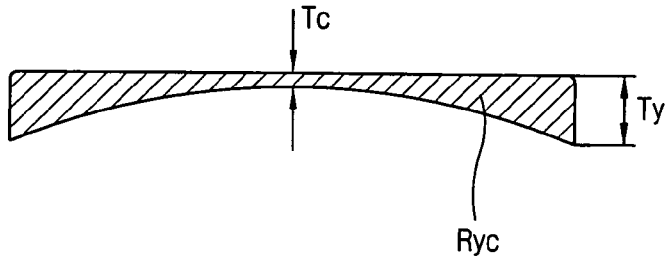
FIG. 3 is a cross section view illustrating Tc by cutting the panel on the basis of the shorter axis(Y) in FIG. 2.
Figure 4:
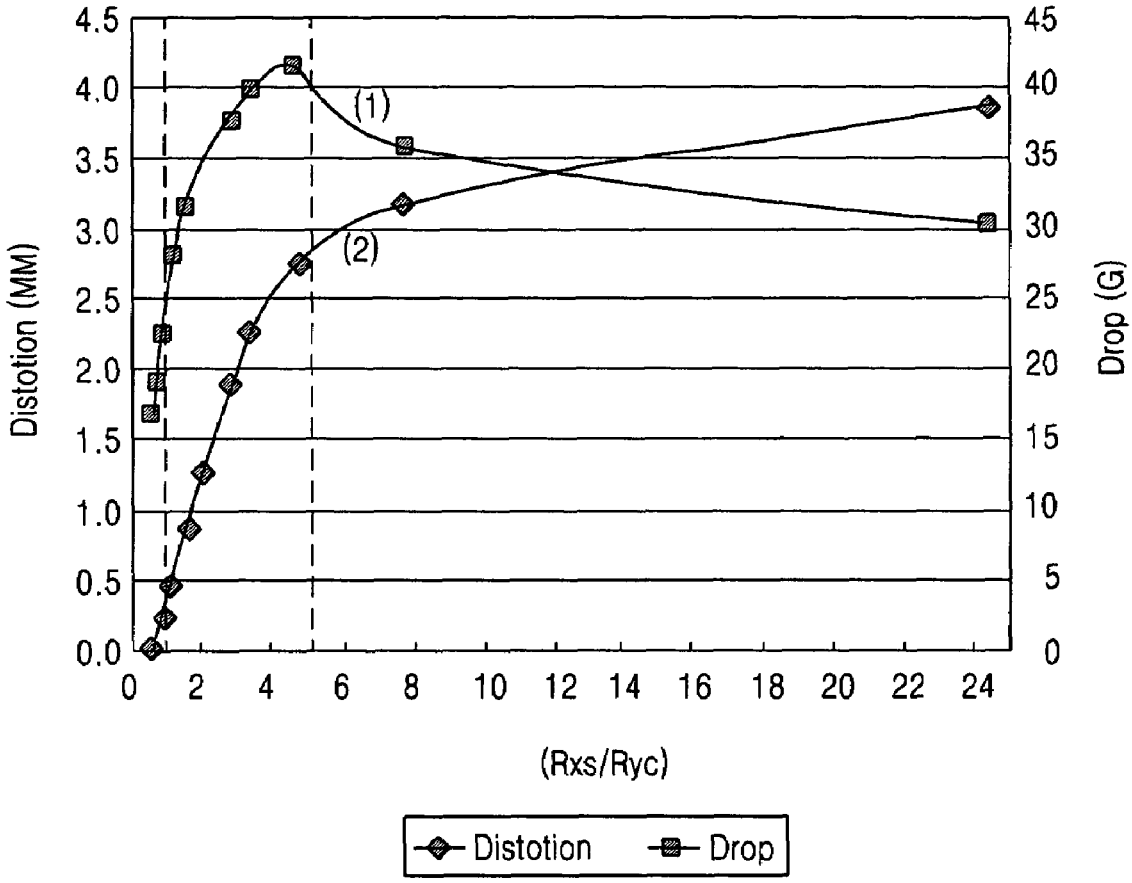
FIG. 4 is a graph showing distortion and drop characteristics as a function of the ratio Rxs/Ryc for the CRT panel in FIG. 2.

FIG. 2 is a perspective view illustrating the effective surface of a CRT panel 10 according to the present invention. FIG. 3 is a cross section view illustrating the thickness of the panel at the center (Tc) by cutting the panel on the basis of the shorter axis(Y) in FIG. 2. As shown in FIG. 2, Rxs is the radius of curvature of the side of the panel along to X axis, and Rye is the radius of curvature in the center of the panel along the y axis. FIG. 4 is a graph showing distortion and drop characteristics as a function of the ratio Rxs/Ryc for the CRT panel in FIG. 2.

As depicted in FIGS. 2–4, an embodiment of a color CRT in accordance with the present invention includes a panel 10 having an outer curvature radius not less than 30,000 mm, namely, a substantially flat outer surface and an inner surface having a certain curvature, and a mask (not shown) having a plurality of electron beam passing holes. A tinted panel having a central portion transmittance rate of 45–75% or a clear panel having a central portion transmittance rate not less than 75% may be used in the present invention.

The present invention may be applied to not only to a large-sized color CRT, including a panel having an effective surface diagonal size (diameter) not less than 534 mm, but also a small-sized color CRT including a panel having an effective surface diagonal size not greater than 534 mm.

Hereinafter, a CDT that is a color CRT having a diameter not greater than 534 mm will be described.

In the present invention, a shorter axis "Y", a longer axis "X", a diagonal axis "D", and an inner curvature radius position hypothetically formed on the inner surface of the panel 10 are defined as following.

As depicted in FIGS. 2 and 3, in defining the axes, a hypothetical line drawn in the vertical direction of the panel through the central point "O" of the panel is defined as the shorter axis "Y", a hypothetical line drawn in the horizontal direction of the panel 10 is defined as the longer axis "X", and a hypothetical line drawn in the diagonal direction of the panel 10 is defined as the diagonal axis "D".

An inner curvature radius of the panel 10 following the shorter axis "Y" through an inner central point "O" is defined as "Ryc", an inner curvature radius of the panel 10 following the longer axis "X" is defined as "Rxc", an inner curvature radius of the panel 10 following the diagonal axis "D" is defined as "Rdc", an inner curvature radius of a shorter side "S" of the effective surface is defined as "Rys", and an inner curvature radius of a longer side "L" of the effective surface is defined as "Rxs".

The thickness of the central portion of the panel is defined as "Tc", the thickness of the end of the effective surface following the shorter axis "Y" is defined as "Ty", the thickness of the end of the effective surface following the longer axis "X" is defined as "Tx", and the thickness of the end of the effective surface following the diagonal axis "D" is defined as "Td".

In order to help in understanding the present invention, the concepts of curvature and curvature radius will be described briefly.

Curvature means a curved degree, and curvature radius means a radius. Accordingly, the greater the curvature, the less the curvature radius is, and the curved degree is greater. On the contrary, the less the curvature, the greater the curvature radius is, and the curved degree is smaller.

In the embodiment of the color CRT in accordance with the present invention, the panel satisfies the following condition $1.1 \leqq (Rxs/Ryc) \leqq 4.6$. This relationship means that an inner curvature of the longer side "L" of the effective surface "E" is less than an inner curvature radius of the panel 10 following the shorter axis "Y" through the central point "O".

FIG. 4 is a graph showing the distortion or drop characteristics of the panel when (Rxs/Ryc) ranges from 1.1 to 4.6. In FIG. 4, the horizontal axis shows a range of (Rxs/Ryc), the vertical axis shows a range of distortion, a curved line 1 is the drop characteristics curved line, and a curved line 2 is the distortion line. As depicted in FIG. 4, when (Rxs/Ryc) ranges from 1.1 to 4.6, in particular in the range of 1.1–2.7, the drop characteristics satisfy the regulation value (not less than 30 G), and distortion is decreased.

In addition, the panel may satisfy the following condition $0.9 \leqq (Ty/Tx) \leqq 1.3$, $(Td/Tc) \leqq 1.5$, wherein Ty is the thickness of the panel at the edge where the "Y" axis crosses, Tx is the thickness of the panel at the edge where the "X" axis crosses, and Td is the thickness of the panel at the corner. Also, the thickness of the mask, (Tm, not shown) to improve the structural strength of the mask is defined to be not less than 0.13 mm in the conventional color CRT. However, in the embodiment of the color CRT in accordance with the present invention, when (Rxs/Ryc) ranges from 1.1 to 4.6, and the thickness of the mask is not greater than 0.13 mm, it is still impossible to maintain the structural strength of the mask above the regulation value. Herein, it is preferable to limit the thickness of the mask (Tm) within the range of $0.10\ mm \leqq Tm \leqq 0.12\ mm$.

In addition, when the effective surface diagonal size is defined as 1R=an effective surface diagonal size of panel*1.767, it satisfies $1.3R \leqq Ryc \leqq 3.3R$ or $1.8R \leqq Rxs \leqq 5.8R$.

In addition, on the basis of the effective surface boundary, in relation between Rys. Also the panel may satisfy the following condition $(Rxs/Rys) \geqq 1.1$ wherein Rys is an inner curvature radius of the shorter side "S" of the effective surface and Rxs is an inner curvature radius of the longer side "L" of the effective surface. Herein, $(Rxs/Rys) \geqq 1.1$ means that Rxs is greater than Rys. In other words, an inner curvature radius of the longer side "L" of the effective surface "E" is less than an inner curvature radius of the shorter side "S" of the effective surface "E".

In addition, the panel may satisfy the following conditions $(Rys/Ryc) \leqq 0.8$ and $0.9 \leqq (Rxs/Ryc) \leqq 1.1$.

Also, when $Rxc \geqq Rdc \geqq Ryc$ and the curvature radius is increased in the shorter axis "Y" direction, a curvature radius is decreased in the longer axis "X" direction, and accordingly an inner curvature radius of the panel 10 is formed as a cylindrical shape.

Table 1 shows simulation values of distortion and drop characteristics in relation to Rxc, Ryc, Rdc.

TABLE 1

| Item | Representative Curvature Radius | | | Effective Surface Boundary | | Thickness | | | Difference of height | | | Rxs/ | | Drop |
|---|---|---|---|---|---|---|---|---|---|---|---|---|---|---|
| | Rx | Ry | Rd | Rxs | Rys | tx | ty | td | Zx | Zy | Zd | Ryc | Distortion | (G) |
| Embodiment of the present invention | 2300 | 1295 | 1800 | 2300 | 1295 | 15.99 | 16.16 | 21.65 | 5.75 | 5.75 | 11.51 | 1.776 | 1.420 | 31 |
| 1 | 2600 | 2600 | 1805 | 1538 | 1167 | 15.99 | 13.27 | 21.62 | 5.09 | 2.86 | 11.48 | 0.592 | 0.041 | 15 |
| 2 | 2600 | 2300 | 1805 | 1607 | 1167 | 15.99 | 13.64 | 21.62 | 5.09 | 3.23 | 11.48 | 0.699 | 0.222 | 17 |
| 3 | 2600 | 2000 | 1805 | 1708 | 1167 | 15.99 | 14.13 | 21.62 | 5.09 | 3.72 | 11.48 | 0.854 | 0.458 | 20 |
| 4 | 2600 | 1700 | 1805 | 1865 | 1167 | 15.99 | 14.78 | 21.62 | 5.09 | 4.38 | 11.48 | 1.097 | 0.776 | 25 |
| 5 | 2600 | 1400 | 1805 | 2149 | 1167 | 15.99 | 15.73 | 21.62 | 5.09 | 5.32 | 11.48 | 1.535 | 1.232 | 28 |
| 6 | 2600 | 1100 | 1805 | 2815 | 1167 | 15.99 | 17.18 | 21.62 | 5.09 | 6.78 | 11.48 | 2.559 | 1.939 | 33 |
| 7 | 2600 | 1000 | 1805 | 3293 | 1167 | 15.99 | 17.87 | 21.62 | 5.09 | 7.46 | 11.48 | 3.293 | 2.269 | 35 |
| 8 | 2600 | 900 | 1805 | 4158 | 1167 | 15.99 | 18.70 | 21.62 | 5.09 | 8.30 | 11.48 | 4.620 | 2.675 | 37 |
| 9 | 2600 | 800 | 1805 | 6204 | 1167 | 15.99 | 19.75 | 21.62 | 5.09 | 9.34 | 11.48 | 7.755 | 3.182 | 32 |
| 10 | 2600 | 700 | 1805 | 7703 | 1167 | 15.99 | 21.11 | 21.62 | 5.09 | 10.70 | 11.48 | 24.333 | 3.839 | 27 |

When Rxc and Rdc are respectively fixed as 2600 mm and 1805 mm, and Ryc has 10 different values, Table 1 shows the effective surface size, thickness, curvature value, Rxs/Ryc, distortion and drop characteristics values. As shown in Table 1, the items satisfying the drop characteristics as not less than 30 G and having the appropriate distortion are within the range of items 5–7, and the best performing value of (Rxs/Ryc) is measured as 1.776.

Figure 5A:
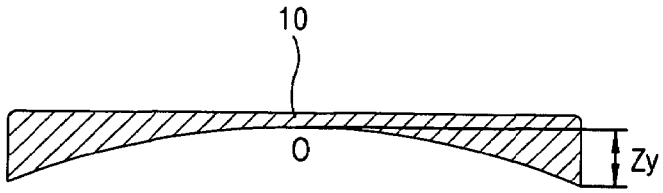
FIG. 5A shows a cross-sectional view along the shorter axis (Y) in FIG. 2 illustrating Zy.
Figure 5B:
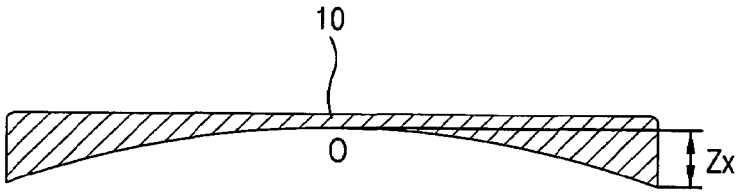
FIG. 5B shows a cross-sectional view along the longer axis (X) illustrating Zx in FIG. 2.

FIG. 5A shows a cross-sectional view along the shorter axis (Y) in FIG. 2 illustrating Zy; FIG. 5B shows a cross-sectional view along the longer axis (X) illustrating Zx in FIG. 2; and FIG. 5C shows a cross-sectional view along the dialog axis (D) in FIG. 2 illustrating Zd.

Figure 5C:
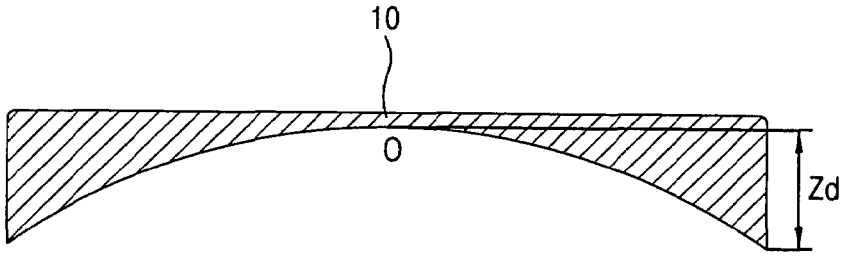
FIG. 5C shows a cross-sectional view along the dialog axis (D) in FIG. 2 illustrating Zd.

As depicted in FIGS. 5A–5C, an embodiment of the color CRT in accordance with the present invention includes a panel 10 having a substantially flat outer surface and an inner surface having a certain curvature; and a mask (not shown) having a plurality of electron beam passing holes. In more detail, a CDT that is a color CRT having an effective surface diagonal size of the panel 10 not greater than 534 mm will be described.

"Zy" is a difference in height between the inner surface at the central point and the effective surface end portion at the edge of the panel along the shorter axis "Y". "Zx" is a difference in height between the inner surface at the central point and the effective surface end portion at the edge of the panel along the longer axis "X", and "Zd" is a difference in height between the inner surface at the central point and the effectve surface end portion at the edge of the panel along the diagonal axis "D" on the basis of the central point "O".

In an embodiment of the color CRT in accordance with the present invention, Zy may satisfy $(0.4*Zd) \leqq Zy \leqq (0.6*Zd)$, or Zx may satisfy $(0.4*Zd) \leqq Zx \leqq (0.6*Zd)$. It is more preferable for Zx to satisfy $0.44*Zd \leqq Zx \leqq 0.56*Zd$, it is more preferable for Zy to satisfy $0.44*Zd \leqq Zy \leqq 0.56*Zd$, and it is more preferable for Zx and Zy to be 50% Zd.

Z(y/2), Z (x/2), and Z(d/2) are the difference in height between in the inner surface at the central point half way between the central point and an edge of the panel along the "Y", "X", and "S" axes, respectively. Also, Z(y/2) may satisfy $0.21*Zy \leqq Z(y/2) \leqq 0.25*Zy$, Z(x/2) may satisfy $0.23*Zx \leqq Z(x/2) \leqq 0.27*Zx$, and Z(d/2) may satisfy $0.22*Zd \leqq Z(d/2) \leqq 0.26*Zd$.

In addition, it is preferable for the mask to have a thickness not greater than 0.15 mm, and it is preferable for the panel 10 to have a wedge ratio ranging from 180 to 230%. A difference of height of the mask (not shown) is determined similar to the difference of height of the panel 10. "Z'y" is a difference in height in the mask between the central point and the effective surface end portion at the end of the mask along the shorter axis "Y". "Z'x" is a difference in height in the mask between the central point and the effective surface end portion at the end of the mask along the longer axis "X", and "Z'd" is a difference in height in the mask between the central point and the effective surface end portion at the end of the mask along the diagonal axis "D", It is preferable for Z'x to satisfy $0.35*Z'd \leqq Z'x \leqq 0.65*Z'd$, and it is preferable for Z'y to satisfy $0.35*Z'd \leqq Z'y \leqq 0.65*Z'd$.

As described above, in order to secure the structural strength of the mask in the related art, the thickness is defined as not less than 0.15 mm, and wedge ratio is defined as not less than 230% in the conventional color CRT. However, in an embodiment of the color CRT in accordance with the present invention, although thickness of the mask is not greater than 0.12 mm and wedge ratio is not greater than 210%, it is possible to provide structural strength of the mask above the regulation value (not less than 30 G), obtain a CI effect according to thickness decrease of the panel 10, and prevent partial doming and howling efficiently by improving drop characteristics.

Hereinafter, the conventional color CRT having a Zx/Zd ratio of 30% and Zy/Zd ratio of 60% will be compared with an embodiment of the present invention having an Zx/Xd ratio as 50% and Zy/Zd ratio as 50%. As described above, in the color CRT using an AK mask, Table 2 shows the drop characteristics and B/U according to wedge ratio of the panel 10, and FIG. 6A is a graph according to Table 2.

TABLE 2

| | Wedge Ratio | | | | | |
|---|---|---|---|---|---|---|
| | 170 | 180 | 190 | 200 | 210 | 220 |
| Drop Characteristics | 25 | 30 | 35 | 40 | 45 | 50 |
| B/U | 80 | 78 | 76 | 74 | 72 | 70 |

Figure 6A:
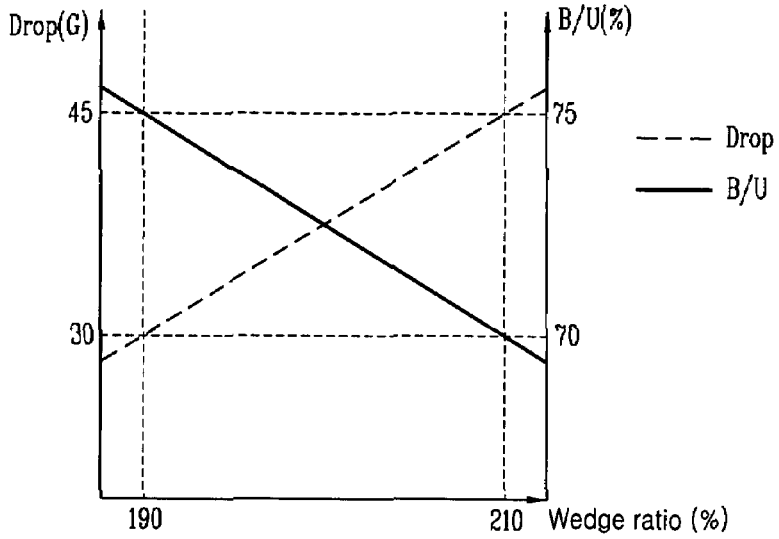
FIG. 6A is a graph showing the drop characteristics and B/U according to a panel wedge ratio in a color CRT using an AK mask.

As depicted in Table 2 and FIG. 6A, when the panel wedge ratio is greater than or equal to 190%, a general monitor brown tube (CDT) can meet drop characteristics above 30 G. However, when the panel wedge ratio is not less than 210%, it is difficult to use a tint panel because B/U, the brightness ratio of the center to the corner in a screen of a monitor, is not greater than 70% in the panel. Accordingly, in order to use an AK mask and a tint panel, when panel wedge ranges from 180–210% and B/U ranges from 72–78%, it is possible to satisfy the requirements of a monitor brown tube.

Figure 6B:
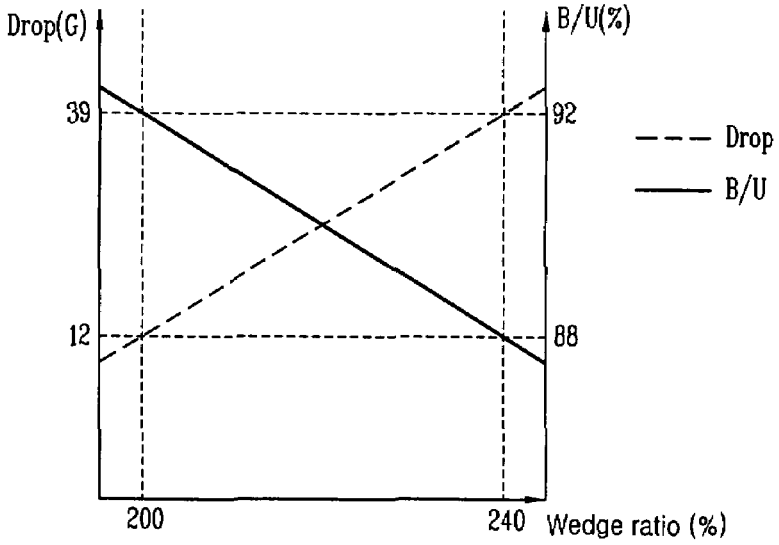
FIG. 6B is a graph showing drop characteristics and B/U according to a panel wedge ratio in a color CRT using an invar mask.

Table 3 shows the drop characteristics and B/U according to panel wedge ratio for a CRT using an invar mask, and FIG. 6B shows a graph according to Table 3.

TABLE 3

| | Wedge Ratio | | | | | |
|---|---|---|---|---|---|---|
| | 190 | 200 | 210 | 220 | 230 | 240 |
| Drop Characteristics | 28 | 30 | 32 | 34 | 36 | 38 |
| B/U | 93 | 92 | 91 | 90 | 89 | 88 |

As depicted in Table 3 and FIG. 6B, in order to satisfy the drop characteristics for the invar mask, the wedge ratio has to be not less than 200%, and B/U has to be satisfied regardless of wedge ratio.

Figure 7:
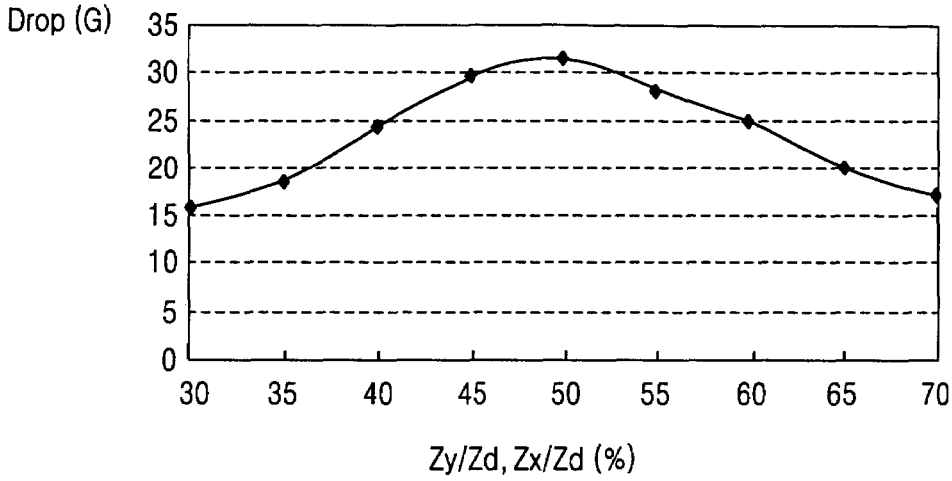
FIG. 7 is a graph showing drop characteristics versus Zx/Zd, Zy/Zd when the wedge ratio is fixed at 206%.

FIG. 7 is a graph showing drop characteristics versus Zx/Zd, Zy/Zd when the wedge ratio is fixed at 206%. The horizontal axis represents Zx/Zd ratio and Zy/Zd ratio, and the vertical axis represents drop characteristics. As depicted in FIG. 7, in the conventional color CRT when Zy/Zd is 35%, the drop characteristic value is 18 G, and when Zx/Zd is 65%, the drop characteristic value is 20 G. In an embodiment of the present invention, when Zx/Zd and Zy/Zd are respectively 50%, a drop characteristic value above 30 G results.

The test results show that the drop characteristics have been greatly improved for a CRT in accordance with the present invention.

Figure 8:
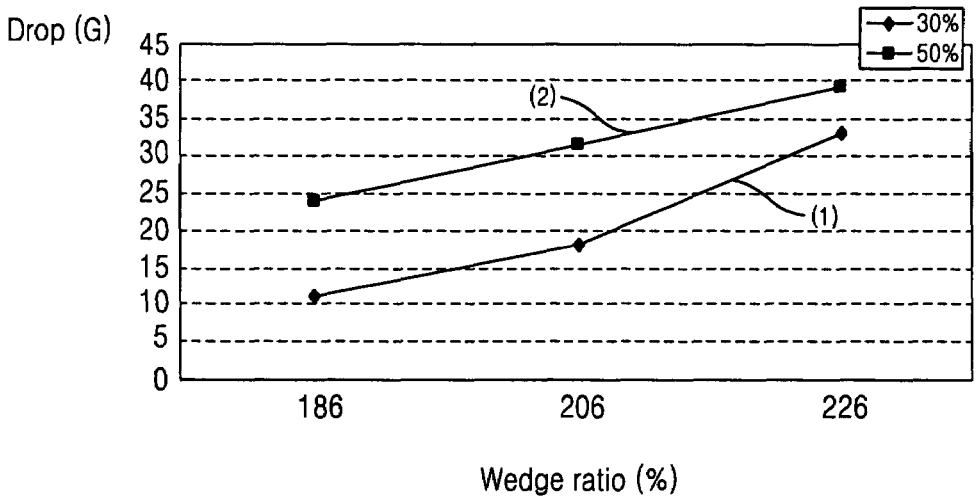
FIG. 8 is a graph showing drop characteristics versus Zx/Zd and Zy/Zd when the wedge ratio is varied as 186%, 206%, 226%.

FIG. 8 is a graph showing drop characteristics versus Zx/Zd and Zy/Zd when the wedge ratio is varied as 186%, 206%, 226%. The horizontal axis represents wedge ratio, and the vertical axis represents drop characteristics. A curved line (1) shows a conventional color CRT having Zy/Zd and Zx/Zd as 35%, and a curved line (2) shows another embodiment of the color CRT having Zy/Zd and Zx/Zd as 50%. As depicted in FIG. 8, when the panel wedge ratio is 186%, the curved line 2 shows drop characteristics superior to that of the curved line 1 by a factor of 2.2. When the panel wedge ratio is 226%, the curved line 2 shows drop characteristics superior to that of the curved line 1 by a factor of 1.2.

In the present invention with Zy/Zd and Zx/Zd as 35%, a lower panel wedge ratio improves performance over a conventional CRT.

Figure 9:
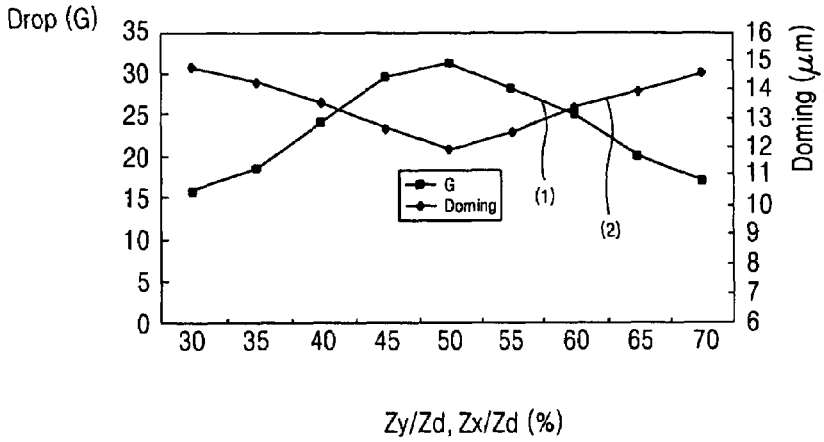
FIG. 9 is a graph showing drop characteristics and doming versus Zx/Zd.

FIG. 9 is a graph showing drop characteristics and doming versus Zx/Zd. The horizontal axis represents Zx/Zd and Zy/Zd, the left side vertical axis represents drop characteristics, the right side vertical axis represents mask doming, a curved line 1 shows drop characteristics, and a curved line 2 shows doming. As depicted in FIG. 9, when Zy/Zd and Zx/Zd is 50%, the drop characteristics are improved, and the partial doming is decreased.

Figure 10:
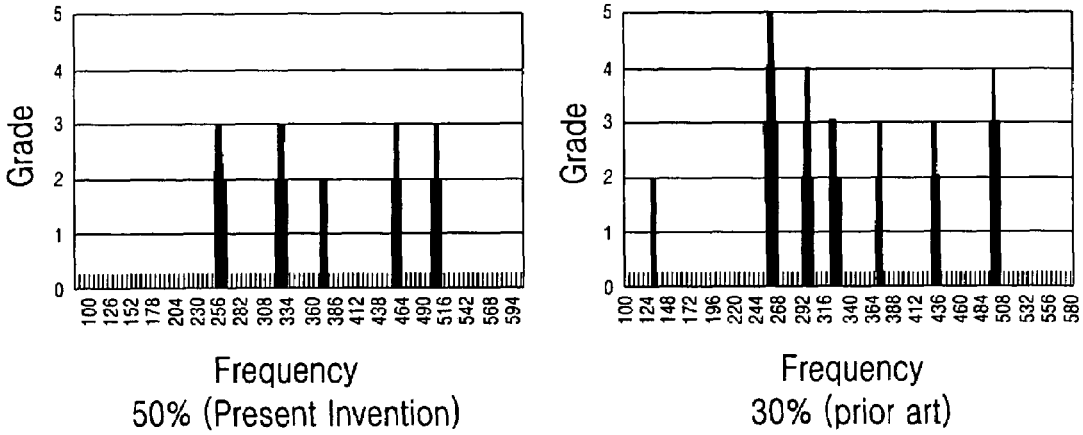
FIG. 10 is a graph showing howling versus Zx/Zd and Zy/Zd.

FIG. 10 is a graph of howling versus Zx/Zd and Zy/Zd. The horizontal axis represents frequency and the vertical axis represents a mask howling level. Herein, the frequency is within the range of 100 to 600 kHz. With reference to FIG. 10 howling has been reduced in the color CRT in accordance with an embodiment of the present invention having Zx/Zd and Zy/Zd as 50% as compared to a conventional color CRT having Zx/Zd and Zy/Zd as 30%.

As described above, with respect to the present invention, when the inner curvature radius of the panel ranges from 1.1–4.6 and Zx/Zd and Zy/Zd is 50%, and although the thickness of the mask is not greater than 0.12 mm and panel wedge ratio is not greater than 210%, it is possible to have the structural strength of the mask above the regulation value, to obtain a CI effect according to thickness decrease of the panel, and to prevent partial doming and howling by improving drop characteristics.

It will be apparent to those skilled in the art that various modifications and variation can be made in the present invention without departing from the spirit and scope of the invention. Thus, it is intended that the present invention cover the modifications and variations of this invention provided they come within the scope of the appended claims and their equivalents.

What is claimed is:

1. A color CRT comprising:

a panel having a substantially flat outer surface and an inner surface having a certain curvature; and a mask having a plurality of electron beam passing holes;

wherein an effective surface diagonal size of the panel is not greater than about 534 mm;

wherein a central portion transmittance rate is within the range of about 45–75%;

wherein the panel satisfies the condition $1.5 \leqq (Rxs/Ryc) \leqq 3.3$;

wherein Rxs is defined as an inner curvature radius along an edge of a longer side of the panel; and wherein Ryc is defined as an inner curvature radius along a line in the center of the panel parallel to the shorter side of the panel.

2. The color CRT of claim 1, wherein the panel satisfies the following condition $0.9 \leqq (Ty/Tx) \leqq 1.3$, wherein Ty is the thickness of the panel at the center of the longer edge of the effective area of the panel and Tx is the thickness of the panel at the center of the shorter edge of the effective area of the panel.

3. The color CRT of claim 1, wherein the panel satisfies the following condition $(Td/Tc) \geqq 1.5$, wherein Td is the thickness of the panel at a corner of the effective area of the panel and Tc is the thickness of the panel at a central point of the panel.

4. The color CRT of claim 1, wherein an outer surface curvature radius of the panel is not less than about 30,000 mm.

5. The color CRT of claim 1, wherein the panel satisfies the following condition $1.5 \leqq (Rxs/Ryc) \leqq 2.7$.

6. The color CRT of claim 1, wherein the thickness of the mask is not greater than about 0.13 mm.

7. The color CRT of claim 6, wherein the panel satisfies the following condition $0.10\ mm \leqq Tm \leqq 0.12\ mm$, wherein Tm is the thickness of the mask.

8. The color CRT of claim 1, wherein the panel satisfies the following condition $1.3R \leqq Ryc \leqq 3.3R$, wherein R is 1.767*an effective surface diagonal size of the panel.

9. The color CRT of claim 8, wherein the panel satisfies the following condition $1.8R \leqq Rxs \leqq 5.8R$.

10. The color CRT of claim 1, wherein the panel satisfies the following condition $(Rxs/Rys) \geqq 1.1$, wherein Rys is defined as an inner curvature radius along an edge of a shorter side of the panel.

11. The color CRT of claim 1, wherein the panel satisfies the following condition (Rys/Ryc)≦0.8, wherein Rys is defined as an inner curvature radius along an edge of a shorter side of the panel.

12. The color CRT of claim 1, wherein the panel satisfies the following condition Rxc≧Rdc≧Ryc, wherein Rxc is defined as an inner curvature radius along a line in the center of the panel parallel to the longer side of the panel and wherein Rdc is defined as an inner curvature radius along a diagonal line of the panel.

13. A color CRT comprising:

a panel having a substantially flat outer surface and an inner surface having a certain curvature; and a mask having a plurality of electron beam passing holes;

wherein an effective surface diagonal size of a panel is not greater than about 534 mm;

wherein the panel satisfies the following condition 1.5≦(Rxs/Ryc)≦3.3;

wherein Rxs is defined as an inner curvature radius along an edge of a longer side of the panel; and wherein Ryc is defined as an inner curvature radius along a line in the center of the panel parallel to the shorter side of the panel.

14. The color CRT of claim 13, wherein the panel satisfies the following condition 0.9≦(Ty/Tx)≦1.3, wherein Ty is the thickness of the panel at the center of the longer edge of the effective area of the panel and Tx is the thickness of the panel at the center of the shorter edge of the effective area of the panel.

15. The color CRT of claim 13, wherein the panel satisfies the following condition (Td/Tc)≧1.5 mm, wherein Td is the thickness of the panel at a corner of the effective area of the panel and Tc is the thickness of the panel at a central point of the panel.

16. The color CRT of claim 13, wherein an outer surface curvature radius of the panel is not less than about 30,000 mm.

17. The color CRT of claim 13, wherein the panel satisfies the following condition 1.5≦(Rxs/Ryc)≦2.7.

18. The color CRT of claim 13, wherein thickness of the mask is not greater than about 0.13 mm.

19. The color CRT of claim 13, wherein the mask satisfies the following condition 0.10 mm≦Tm≦0.12 mm, wherein Tm is the thickness of the mask.

20. The color CRT of claim 13, wherein the panel satisfies the following condition 1.3 R≦Ryc≦3.3R, wherein R is 1.767*an effective surface diagonal size of the panel.

21. The color CRT of claim 13, wherein the panel satisfies the following condition 1.8R≦Rxs≦5.8R, wherein R is 1.767*an effective surface diagonal size of the panel.

22. The color of claim 13, wherein the panel satisfies the following condition (Rxs/Rys)≧1.1, wherein Rys is defined as an inner curvature radius along an edge of a shorter side of the panel.

23. A color CRT comprising:

a panel having a substantially flat outer surface and an inner surface having a certain curvature; and a mask having a plurality of electron beam passing holes;

wherein an effective surface diagonal size of a panel is not greater than about 534 mm;

wherein the panel satisfies one of the conditions (0.4*Zd)≦Zy≦(0.6*Zd) and (0.4*Zd) ≦Zx≦(0.6*Zd);

wherein Zd is height difference between a point on the inner surface of the panel at the central point and a point on the inner surface of the panel at the corner of the effective area of the panel;

wherein Zy is height difference between a point on the inner surface of the panel at the central point and a point on the inner surface of the panel at the center of the longer edge of the effective area of the panel; and wherein Zx is height difference between a point on the inner surface of the panel at the central point and a point on the inner surface of the panel at the center of the shorter edge of the effective area of the panel;

wherein the panel satisfies the following condition 0.22*Zd≦Z(d/2)≦0.26*Zd, wherein Z(d/2) is height difference between a point on the inner surface of the panel at the central point and a point on the inner surface of the panel halfway between the central point and the corner of the effective area of the panel.

24. The color CRT of claim 23, wherein the panel satisfies one the following conditions (0.44Zd)≦Zy≦(0.56*Zd) and (0.44*Zd)≦Zx≦(0.56*Zd).

25. The color CRT of claim 23, wherein the panel satisfies the following condition 0.21*Zy≦Z(y/2)≦0.25*Zy, wherein Z(y/2) is height difference between a point on the inner surface of the panel at the central point and a point on the inner surface of the panel half way between the central point and the center of the longer edge of the effective area of the panel.

26. The color CRT of claim 23, wherein the panel satisfies the following condition 0.23*Zx≦Z(x/2)≦0.27*Zx, wherein Z(x/2) is height difference between a point on the inner surface of the panel at the central point and a point on the inner surface of the panel half way between the central point and the center of the shorter edge of the effective area of the panel.

27. The color CRT of claim 23, wherein the panel satisfies the following condition 1.5≦(Td/Tc)≦2.3, wherein Td is the thickness of the panel at a corner of the effective area of the panel and Tc is the thickness of the panel at a central point of the panel.

28. The color CRT of claim 23, wherein the panel satisfies the following condition 1≦(Rxs/Ryc)≦5 and wherein Rxs is defined as an inner curvature radius along an edge of a longer side of the panel and wherein Ryc is defined as an inner curvature radius along a line in the center of the panel parallel to the shorter side of the panel.

29. The color CRT of claim 23, wherein a central portion transmittance rate of the panel is within the range of about 45–75%.

30. The color CRT of claim 23, wherein the panel satisfies the following condition 0.9≦(Ty/Tx)≦1.3, wherein Ty is the thickness of the panel at the center of the longer edge of the effective area of the panel and Tx is the thickness of the panel at the center of the shorter edge of the effective area of the panel.

31. The color CRT of claim 23, wherein thickness of the mask is not greater than about 0.13 mm.

32. The color CRT of claim 28, wherein the panel satisfies the following condition 1.3 R≦Ryc≦3.3R, wherein R is 1.767*an effective surface diagonal size of the panel.

33. The color CRT of claim 28, wherein the panel satisfies the following condition 1.8R≦Rxs≦5.8R, wherein R is 1.767*an effective surface diagonal size of the panel.

* * * * *